US010138087B2

(12) United States Patent
Pettersson et al.

(10) Patent No.: US 10,138,087 B2
(45) Date of Patent: Nov. 27, 2018

(54) DEVICE FOR CONTROLLING THE WEB TENSION IN A RUNNING MATERIAL WEB

(71) Applicant: Tetra Laval Holdings & Finance S.A., Pully (CH)

(72) Inventors: Thomas Pettersson, Stockamöllan (SE); Ingvar Andersson, Löddeköpinge (SE); Peter Öhman, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 251 days.

(21) Appl. No.: 15/106,636

(22) PCT Filed: Dec. 19, 2014

(86) PCT No.: PCT/EP2014/078786
§ 371 (c)(1),
(2) Date: Jun. 20, 2016

(87) PCT Pub. No.: WO2015/091975
PCT Pub. Date: Jun. 25, 2015

(65) Prior Publication Data

US 2017/0029230 A1 Feb. 2, 2017

(30) Foreign Application Priority Data

Dec. 20, 2013 (SE) ..... 1351553

(51) Int. Cl.
*B65H 23/16* (2006.01)
*B65H 20/34* (2006.01)

(52) U.S. Cl.
CPC ..... *B65H 23/16* (2013.01); *B65H 20/34* (2013.01); *B65H 2301/522* (2013.01); *B65H 2402/31* (2013.01)

(58) Field of Classification Search
CPC .... B65H 23/16; B65H 20/34; B65H 2402/31; B65H 2301/522
See application file for complete search history.

(56) References Cited

U.S. PATENT DOCUMENTS 2,214,609 A 9/1940 Drake
3,727,820 A 4/1973 Braun
(Continued)

FOREIGN PATENT DOCUMENTS

DE 20 2009 009 097 U1 12/2009
EP 0 602 283 A1 6/1994
(Continued)

OTHER PUBLICATIONS

International Search Report (PCT/ISA/210) dated Mar. 3, 2015, by the Japanese Patent Office as the International Searching Authority for International Application No. PCT/EP2014/078786.
(Continued)

*Primary Examiner* — Sang K Kim
(74) *Attorney, Agent, or Firm* — Renner, Otto, Boisselle & Sklar, LLP

(57) ABSTRACT

Device and method for controlling axial forces acting upon a moving web comprises first, second and third rotatable rollers. The third roller is between the first and second rollers and is movable in a circular path in the vertical plane between lower and upper positions in response to axial forces acting at any moment upon the web. To enable a simple manual installation of the web, the upper position of the third roller is at a sufficient vertical distance above the first and second rollers to form an open horizontal passage through which the web can pass freely between the first and second rollers and the above-situated third roller. Axial forces are controlled by biasing the third roller with a force which counters the motion of the third roller in the direction
(Continued)

of the upper working position and which is less than the ultimate tensile strength of the web.

11 Claims, 2 Drawing Sheets

(56) References Cited

U.S. PATENT DOCUMENTS

| | | | | |
|---|---|---|---|---|
| 4,033,522 | A | 7/1977 | Chesnut et al. | |
| 4,464,916 | A | 8/1984 | Grew et al. | |
| 5,163,594 | A | 11/1992 | Meyer | |
| 5,685,471 | A * | 11/1997 | Taubenberger | B41J 15/06 226/17 |
| 6,352,257 | B1 | 3/2002 | Todaro et al. | |
| 7,337,936 | B2 * | 3/2008 | Ishida | B41J 15/005 226/143 |
| 2004/0140387 | A1 | 7/2004 | Ishida et al. | |
| 2011/0062206 | A1 | 3/2011 | Klein et al. | |
| 2012/0018564 | A1 | 1/2012 | Schmitz | |

FOREIGN PATENT DOCUMENTS

| | | |
|---|---|---|
| FR | 1.016.340 | 11/1952 |
| JP | 2004-155533 A | 6/2004 |

OTHER PUBLICATIONS

Office Action dated Jun. 12, 2014, by the Swedish Patent Office in corresponding Patent Application No. 1351553-1.

Japanese Office Action issued on Sep. 21, 2018 for corresponding Japanese application No. JP 2016-541326 with Office Action Summary partially in English.

* cited by examiner

DEVICE FOR CONTROLLING THE WEB TENSION IN A RUNNING MATERIAL WEB

TECHNICAL FIELD

The present invention relates to a device for controlling axial forces acting upon a material sheet which is unwound from a rotatable horizontal shaft and is led up to and wound onto a corresponding horizontal rotatable shaft, which device comprises a first roller, which is rotatable about a first horizontal shaft, a second roller, which is rotatable about a second horizontal shaft, and a third roller, which is rotatable about a third horizontal shaft, which third roller is placed between the first and second rollers and is movable along an arc-shaped motional path in the vertical plane between a lower position and an upper position in response to axial forces acting at any moment upon the web, which web is intended to be led with its one side into contact with the first and second rollers and with its other side in contact with the third roller.

PRIOR ART

Within packaging engineering, consumer packages of a disposable nature are commonly used for packaging and transporting liquid foods, such as, for example, milk. So-called disposable packages of this type are often made of a laminated packaging material comprising a base layer of paper or cardboard and outer liquid-tight layer of polyethylene. In special cases, such as with particularly oxygen-sensitive foods, for example fruit juice, it is necessary to supplement the packaging material with at least one further layer of a material having oxygen-tight properties, and the most common example of a supplementary material layer of this kind is an aluminium foil between the paper or cardboard layer and one of the two outer liquid-tight layers.

Consumer packages of this sort are nowadays very often produced with the aid of modern rational packaging machines of the sort which, from a web or from prefabricated blanks of the packaging material, both form, fill and also seal finished packages.

Formed, filled and sealed consumer packages are produced from a web, for example, by the web firstly being transformed into a tube by joining together of the two longitudinal edges of the web into a longitudinal liquid-tight sealing joint (so-called lap joint). The tube is filled with the particular food, for example milk, and is divided into connected pillow-shaped pack units by repeated transversal heat sealings of the tube transversely to the longitudinal axis of the tube below the fill product level of the tube. The filled pillow-shaped pack units are separated from one another by cuts in the transverse seals and are subsequently given the desired geometric shape by means of at least one further forming and heat sealing operation. Well-known examples of commercial consumer packages of this kind are Tetra Brik and Tetra Classic packages, which are used to transport liquid foods of the type milk, fruit juice, wine and cooking oil.

A laminated packaging material of the sort which is described above is produced on an industrial scale from a roll of paper or cardboard. A web which is unwound from the roll is led to a first work station where one side of the web, by suitable printing technology, is provided with a recurring pattern of an aesthetic and/or informative nature. In conjunction with or directly after the printing, the web is also provided with a likewise recurring pattern of weakening lines facilitating folding (so called fold lines). In order to give the subsequently produced disposable packages the desired shape and attractive appearance, it is important that these two recurring patterns are applied to the web in closest possible distance from each other.

The web provided with print and fold lines is led onward to a subsequent work operation, in which the web is coated on both sides with respective outer liquid-tight layers, usually polyethylene. In certain cases, such as when the packaging material is intended for packaging containers for particularly oxygen-sensitive products, the packaging material is also provided with at least one further layer of a material having such barrier properties, for example an aluminium foil, on one side of the packaging material between the paper or cardboard layer and one of the two outer liquid-tight coatings.

Finally, the packaging material web is divided up into individual partial webs, which are wound into finished packaging rolls in order to produce the formed, filled and sealed packaging containers.

In order to ensure that the packaging material in the finished packaging rolls meets set quality requirements and is not beset with serious faults and defects which could jeopardize the chemical and/or mechanical protection of the finished packaging containers, the packaging rolls are subjected to a quality control in which the packaging material is repaired.

A repair line of the conventional sort has a rotatable horizontal shaft at its one end and a corresponding rotatable horizontal shaft at its other end. Between the rotatable shafts, the repair line has a repair station, in which detected defects are to be repaired and treated on a stationary web of the packaging material. Since a packaging material can quite often be beset with a number of production faults and these production faults, in turn, can be found at randomly spread points on one and the same packaging material, this means that a web of the packaging material which is led through the repair station can be subjected to several stoppages and starts in connection with the quality control. A stoppage of the web can generally be performed without major problems, but, on the other hand, a following restart can be associated with problems which must be anticipated and prevented in order to avoid further problems. Such further problems are associated with the fact that a stoppage of the web cannot be realized instantaneously, but instead, due to inherent inertia, takes place after a certain retardation process during which the slowing web forms a loop of surplus material in the region before the work station. When the web is then restarted, the length of this surplus material will shrink in line with an increase in speed of the web and finally disappear altogether, whereupon the web at the same moment, is subjected to an axial pull in its direction of movement. In order to prevent such an inevitable axial pull in the web from becoming so strong that it could exceed the ultimate tensile strength of the web and thereby pull the web apart, the known repair line is equipped with a device by which such pulls in the web can be controlled and kept at a level lying well below the ultimate tensile strength of the web.

The device for controlling such tensile and yield stresses at the known repair line has a first roller, which is rotatable about a first horizontal shaft, a second roller, which is rotatable about a second horizontal shaft, and a third roller, which is rotatable about a third horizontal shaft. The third roller between the first and second rotatable rollers is pivotably mounted on a fourth horizontal shaft in such a way that it is displaceable in the vertical direction along a circular arc between an upper working position and a lower working position. The fourth horizontal shaft is mounted at a level below the level for the first and second horizontal shafts. The displacement of the third roller along the circular arc is enabled with the aid of arms, the one ends of which are connected to respective axial ends of the third horizontal shaft and the other ends of which are connected in a corresponding manner to respective axial ends of the fourth horizontal shaft.

When a roll of packaging material is to be checked and repaired, it is suspended from the horizontal rotatable shaft at one end of the repair line. A web of the packaging material is unwound from the suspended roll and is manually advanced for winding onto the horizontal rotatable shaft at the other end of the repair line. En route to the rotatable shaft at the other end, the web is first led through the device for controlling the axial stress of the web and onward from the device through the work station in which detected production faults are to be treated on the web. Since the first and second rotatable rollers have their respective horizontal shafts on a level lying above the corresponding level for the horizontal shaft of the third rotatable roller, the web is thus led in a U-shaped web loop through the whole of the arrangement of rollers in such a way that one side (the bottom side) of the web is led into contact with the first and second rollers, at the same time as the other side (top side) of the web is led into contact with the third roller. Such manual pulling of the web along the U-shaped loop through the known roller arrangement is not only unnecessarily complicated, but also excessively labour-intensive and time-consuming whenever a new roll has to be checked and repaired.

One object of the invention is therefore to eliminate this drawback and provide a device of the sort described in the introduction, which device enables a significantly easier and less time-consuming and labour-intensive manual web pulling than the known device.

A specific object is to provide a device of this type by which the unwound web can be led manually along a substantially straight horizontal path throughout the device.

BRIEF DESCRIPTION OF THE INVENTION

In one aspect, the invention thus provides a device for controlling axial forces acting upon a web which is unwound from a rotatable horizontal shaft and is led up to and wound onto a corresponding horizontal rotatable shaft, which device comprises a first roller, which is rotatable about a first horizontal shaft, a second roller, which is rotatable about a second horizontal shaft, and a third roller, which is rotatable about a third horizontal shaft, which third roller is placed between the first and second rollers and is movable along an arc-shaped motional path in the vertical plane between a lower position and an upper position in response to axial forces acting at any moment upon the web, which web is intended to be led with its one side in contact with the first and second rollers and with its other side in contact with the third roller. The device is characterized in that the third roller, in its upper position, is at a sufficient vertical distance from the first and second rollers to form an open horizontal passage through which the web can pass freely between the two first and second rollers, on the one hand, and the third roller, on the other hand.

In one embodiment of the device according to the invention, the third roller is pivotably suspended on a fourth horizontal rotatable shaft via arms, the one ends of which are connected to respective axial ends of the fourth horizontal shaft and the other ends of which are connected in a corresponding manner to respective axial ends of the third horizontal shaft.

The fourth horizontal shaft can, but does not need to be situated at a higher level in the vertical plane than the two first and second horizontal shafts. If the fourth horizontal shaft is mounted at a level above the two first and second horizontal shafts, the arms are substantially horizontal when the third roller is in its upper position.

In a preferred embodiment, the third roller is biased with a force which counters the motion of the third roller upward in the direction of the upper working position. Preferably, the third roller is biased with a force which is less than the ultimate tensile strength of the particular web.

In a practical application, the device according to the invention is used to control axial tensile and yield forces acting at any moment upon a web of a packaging material which is unwound from a horizontal rotatable shaft and is led up to and wound onto a corresponding horizontal shaft and which, as it passes between the two horizontal shafts, is subjected to at least one slowdown and stoppage with a subsequent accelerating start.

In a further embodiment, the third roller is biased with a freely adjustable force which counters the arc-shaped pivot motion of the third roller upwards towards the upper position. Such a biasing force can be produced in a known manner with suitable pneumatic, hydraulic and mechanical means. In order to avoid rupture of the web due to excessively strong pulls and axial forces upon the web, as is described above, this counterforce must be set at a value below the particular ultimate tensile strength of the web. If the web, for example, has an ultimate tensile force in the order of magnitude of 20,000 N, then the counterforce can be set at a value amounting to just one tenth (1/10) of this, such as 1800-2000 N, in order thus to enable the third roller to be displaced, if the web is acted upon by axial forces, already far below the ultimate tensile strength of the web.

BRIEF DESCRIPTION OF THE FIGURES

The invention will be described in greater detail below with reference to the appended drawings, in which.

DETAILED DESCRIPTION OF THE INVENTION

Figure 1:
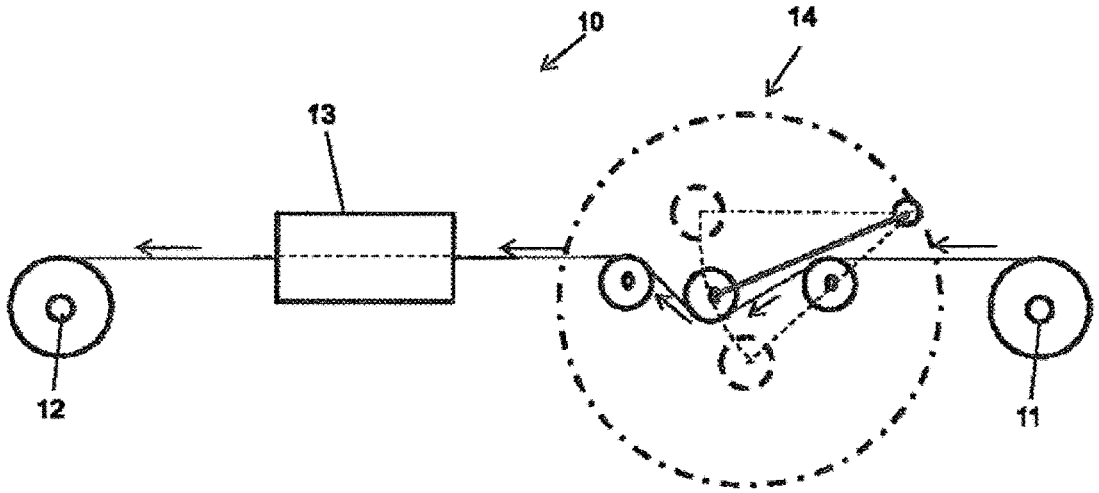
FIG. 1 shows schematically a device according to the invention in connection with a conventional line for treatment of production faults on a web of a packaging material.

FIG. 1 thus shows in schematic representation the placement and use of a device according to the invention for controlling axial forces upon a web of a packaging material which is to be led through a repair line and suitably treated in order to remove faults and defects which have been detected and registered in connection with the earlier production of the packaging material. The repair line, having the general notation 10, has in this example a rotatable horizontal shaft 11 at its one (right-hand) end and a corresponding rotatable horizontal shaft 12 at its other (left-hand) end. Between the rotatable horizontal shafts 11 and 12, the repair line 10 further comprises a repair station 13, through which the web is intended to be led for suitable treatment to remove the particular faults and defects.

A common such measure is based on the web being stopped and held still, at the same time as the web is divided by a straight cut across the whole of the web. The rear part (in the direction of movement of the web) of the thus cut web is subsequently advanced by a distance and halted and held still again at the same time as the thus advanced part of the web is correspondingly cut off and removed by a further straight cut across the whole of the web. The two remaining parts of the web are brought together and subsequently joined together with each other, after which the web is started and led onward until it is stopped again for the next repair at the repair station 13.

From the repair station 13, the repaired web is led further onwards and is wound onto the rotatable horizontal shaft 12 at the other (left-hand) end of the repair line 13.

As stated earlier, a stoppage of the web can generally be performed without major problems, but, on the other hand, problems and disruptions quite often arise in connection with the restart of the web after each stoppage and standstill. Problems and disruptions of this sort are at least partially associated with the fact that a moving web of a packaging material cannot be stopped instantaneously, but rather that a slowdown and stoppage of the web, due to inherent inertia and other dynamic effects, takes place after a continuous retardation process, during which a growing accumulation or loop of the slowing web is formed in conjunction with or immediately before the repair station 13. When the web, after its standstill, is then started and reaccelerated, this accumulation or loop of the web will gradually shrink and finally disappear altogether. At the same moment, the web will thus be subjected to an axial pull, which at the same time subjects the web to an instantaneous strong axial force in the motional direction of the web.

In order to prevent this instantaneous axial force from becoming so large that it even exceeds the ultimate tensile strength of the particular web, the repair line 10, in the shown example, is equipped with a device 14 according to the invention for controlling axial forces upon a web and keeping these at a level below this ultimate tensile strength. The device 14, which in the shown example is placed between the rotatable axial shaft at the one (right-hand) end of the repair line 10 and the repair station 13, will be described in greater detail with reference to FIG. 2, which shows the circled region in FIG. 1 on an enlarged scale.

Figure 2:
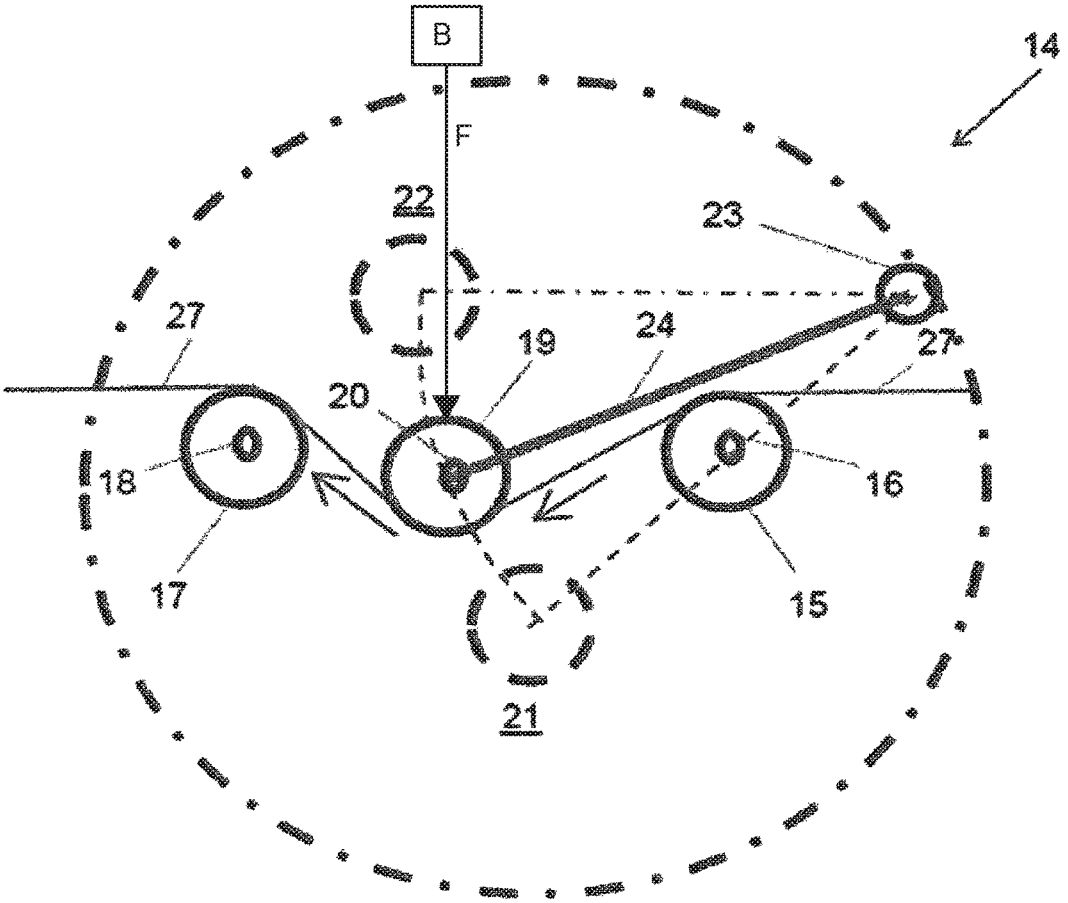
FIG. 2 shows the circled region in FIG. 1 on an enlarged scale.

As can be seen from FIG. 2 (which uses the same reference notations as FIG. 1), the device 14 has a first roller 15, which is rotatable about a first horizontal shaft 16, a second roller 17, which is rotatable about a second horizontal shaft 18, and a third rotatable roller 19, which is rotatable about a third horizontal shaft 20. The third rotatable roller is movable, in response to axial forces acting upon the web at any moment, between a lower position (at 21) and an upper position (at 22) along an arc-shaped motional path (shown in dashed representation) in the vertical plane between the two first and second rotatable rollers 15 and 17.

In the example shown in FIG. 2, such a reactive motion of the third rotatable roller 19 is enabled by the fact that this roller 19 is pivotably suspended on a fourth rotatable shaft 23 via two arms 24 (of which only one is shown), the one ends of which are connected to respective axial ends of the fourth rotatable shaft 23 and the other ends of which are correspondingly connected to respective axial ends of the third rotatable shaft 20.

In order to counter strong axial forces upon the web in connection with pulls when the speed of the web is accelerated, the third rotatable roller 19 is biased with a freely adjustable force F which acts in the direction of the motion of the third roller from the lower position 21. Such a counterforce F can be produced in a known manner with both pneumatic and hydraulic and mechanical means B which act directly upon the fourth rotatable shaft 23, as schematically shown in FIG. 2. In order to avoid rupture of the web due to excessively strong pulls and axial forces upon the web, as is described above, this counterforce F must be set at a value below the particular ultimate tensile strength of the web. If the web, for example, has an ultimate tensile strength in the order of magnitude of 20,000 N, then the counterforce F can be set at a value amounting to just one tenth (1/10) of this, such as 1800-2000 N, in order thus to enable the third roller to be displaced, if the web is acted upon by axial forces, already far below the ultimate tensile strength of the web.

When a wound web of a packaging material has to be checked and action taken to remove detected and registered faults and defects which have arisen in the earlier production of the packaging material, the roll of packaging material is wound onto the horizontal rotatable shaft 16 at the one (right-hand) end of the repair line 10. The web 27 is unwound from the roll 15 and led manually in the direction of the arrows to the left in FIG. 1, right up to being wound onto the horizontal rotatable shaft 18 at the other (left-hand) end of the repair line 10. En route to the horizontal rotatable shaft 18 at the other end of the repair line 10, the web 27 is first led through the device 14 for controlling of the axial stresses of the web 27 and, thereafter, onward to and through the work station 13, in which detected production faults on the web 27 are to be treated.

In order to facilitate the manual pulling of the unwound web 27 along the whole of the repair line 10, the third rotatable roller 19 is held in its upper position 22 with the aid of the arms 24, which have been swung up to their substantially horizontal position, as has been described earlier.

Following completed manual pulling of the web 27, the third rotatable roller 19 is lowered into an optional working position between the upper and lower positions, wherein, in this working position, the one side of the web 27 is in contact with the third rotatable roller 19, at the same time as the other side of the web 27 is in contact with the two first and second rotatable rollers 15 and 17. The rotatable horizontal shaft 18 at the other (left-hand) end of the repair line 10 is rotated with the aid of a suitable drive device, for example an electric motor in connection with the rotatable shaft, and the speed of the web 27 is increased to a predetermined speed, at the same time as the instantaneous position of the web is continuously read with suitable electronic and/or optical means. When a registered fault is detected on the running web 27, the web is stopped after a retarded braking and is held still while the detected fault on the web is treated at the repair station 13, as is described above. Once the fault has been remedied, the web 27 is restarted and accelerated to the predetermined web speed for continued checking and repair.

Throughout the period during which the web is kept in motion along the repair line 10, axial forces to which the web is subjected, especially in connection with restart after standstill, are monitored and controlled with the aid of the device 14 according to the invention. Such axial stresses are especially controlled such that they do not at any point exceed the ultimate tensile strength of the particular web, as is described in greater detail above.

Even though the invention has been described above with special reference to a use in connection with a web of a packaging material, it is not in any respect limited to this use. In principle, the device according to the invention can be used in connection with any other type of web which in motion is at risk of being subjected to excessive axial stresses. The following patent claims should therefore be interpreted in their widest possible scope.

INDUSTRIAL APPLICABILITY

The device according to the invention is especially, but not exclusively usable for controlling axial tensile stresses acting upon a web of a packaging material when this is subjected to repeated stoppages and accelerating speed variations upon restart. The device is particularly usable for controlling and maintaining tensile stresses at a level lying well below the ultimate tensile strength of the particular web.

The invention claimed is:

1. A device for controlling axial forces acting upon a web which is unwound from a horizontal rotatable shaft and is led up to and wound onto a corresponding horizontal rotatable shaft, wherein the device comprises a first roller, which is rotatable about a first horizontal shaft, a second roller, which is rotatable about a second horizontal shaft, and a third roller, which is rotatable about a third horizontal shaft, wherein the third roller is placed between the first and second rollers and is movable along an arc-shaped motional path in the vertical plane between a lower position and an upper position in response to axial forces acting at any moment upon the web, wherein the web is intended to be led with one side in contact with the first and second rollers and with another side in contact with the third roller, wherein the third roller, in the upper position, is at a vertical distance above the first and second rollers to form an open horizontal passage through which the web can pass freely between the first and second rollers and the above-situated third roller, wherein the third roller is biased with a force which counters the motion of the third roller in the direction of the upper working position and which is less than an ultimate tensile strength of the web.

2. The device according to claim 1, wherein the third roller is pivotably suspended on a fourth horizontal rotatable shaft via arms, the one ends of which are connected to respective axial ends of the fourth horizontal shaft and the other ends of which are connected in a corresponding manner to respective axial ends of the third horizontal shaft.

3. The device according to claim 2, wherein the fourth horizontal shaft is located at a higher level in the vertical plane than the first and the second horizontal shafts.

4. The device according to claim 2, wherein the arms are substantially horizontal when the third roller is in the upper position.

5. The device according to claim 1, wherein the arms are substantially horizontal when the third roller is in the upper position.

6. The device according to claim 1 for controlling axial tensile and yield forces acting at any moment upon a web of a packaging material which is unwound from the horizontal rotatable shaft and is led up to and wound onto the corresponding horizontal shaft and which, as the packaging material passes between the two horizontal shafts, is subjected to at least one slowdown and stoppage with a subsequent accelerating start in motion.

7. A method for controlling axial forces acting upon a web which is unwound from a horizontal rotatable shaft and is led up to and wound onto a corresponding horizontal rotatable shaft, comprising:

leading the web with it its one side into contact with a first roller and second roller, the first and second rollers being rotatable around a first and second horizontal shafts, respectively;

lowering a third roller, rotatable around a third horizontal shaft from a sufficient vertical distance above the first and second rollers to form an open horizontal passage through which the web can pass, into contact with the web, such that the third roller contacts the web at a side different from the one side in contact with the first and second rollers; and biasing the third roller with a force to counter motion of the third roller in the direction of the upper working position, where the force is less than an ultimate tensile strength of the web.

8. A device operable together with a repair unit that removes faults and defects in a packaging material web and that is positioned between one horizontal rotatable shaft and another horizontal rotatable shaft to control axial forces acting upon a packaging material web which is unwound from the one horizontal rotatable shaft passed though the repair unit and the wound onto the other horizontal rotatable shaft, the packaging material web possessing an ultimate tensile strength and also including oppositely facing first and second sides, the device comprising:

a first roller rotatable about a first horizontal shaft;

a second roller rotatable about a second horizontal shaft that is spaced from the first horizontal shaft;

a third roller rotatable about a third horizontal shaft that is spaced from the first horizontal shaft and the second horizontal shaft;

the third roller being vertically movable, in response to axial forces acting at any moment on the web, along an arc-shaped movement path that passes between the first and second rollers so that the third roller is movable between an upper position and a lower position;

the first roller being positioned relative to the one horizontal rotatable shaft such that the first side of the packaging material web contacts the first roller as the packaging material web is being unwound from the one horizontal rotatable shaft;

the second roller being positioned relative to the other horizontal rotatable shaft such that the first side of the packaging material web contacts the second roller as the packaging material web is being wound onto the other horizontal rotatable shaft;

the third roller being positioned to contact the second side of the packaging material web, the third roller in the upper position is spaced vertically above the first and second rollers by a distance forming an open horizontal passage through which the packaging material web is freely passable between the first and second rollers while the third roller is vertically above the horizontal passage, the third roller being biased by a force which counters motion of the third roller in a direction of the upper working position and which is less than an ultimate tensile strength of the packaging material web.

9. The device according to claim 8, wherein the third roller is pivotably suspended on a fourth horizontal rotatable shaft by way of arms, the arms each possessing one end connected to respective axial ends of the fourth horizontal rotatable shaft, and the arms each possessing an opposite end connected in a corresponding manner to respective axial ends of the third horizontal shaft.

10. The device according to claim 9, wherein the fourth horizontal shaft is positioned higher, in a vertical plane, than the first and the second horizontal shafts.

11. The device according to claim 9, wherein the arms are substantially horizontal when the third roller is in the upper position.

* * * * *